US007278925B2

(12) United States Patent
Oyama

(10) Patent No.: US 7,278,925 B2
(45) Date of Patent: Oct. 9, 2007

(54) GOLF CLUB HEAD

(75) Inventor: Hitoshi Oyama, Kobe (JP)

(73) Assignee: SRI Sports Limited, Kobe (JP)

( * ) Notice: Subject to any disclaimer, the term of this patent is extended or adjusted under 35 U.S.C. 154(b) by 319 days.

(21) Appl. No.: 10/948,333

(22) Filed: Sep. 24, 2004

(65) Prior Publication Data

US 2005/0090331 A1 Apr. 28, 2005

(30) Foreign Application Priority Data

Oct. 22, 2003 (JP) ..... 2003-362383

(51) Int. Cl.
*A63B 53/04* (2006.01)

(52) U.S. Cl. ..... 473/329; 473/345; 473/349

(58) Field of Classification Search ..... 473/324–350, 473/290–292

See application file for complete search history.

(56) References Cited

U.S. PATENT DOCUMENTS

| | | | | |
|---|---|---|---|---|
| 4,432,549 | A * | 2/1984 | Zebelean | 473/346 |
| 4,489,945 | A * | 12/1984 | Kobayashi | 473/346 |
| 5,028,049 | A * | 7/1991 | McKeighen | 473/345 |
| 5,056,788 | A * | 10/1991 | Katayama | 473/291 |
| 5,141,230 | A * | 8/1992 | Antonious | 473/327 |
| 5,318,300 | A * | 6/1994 | Schmidt et al. | 473/305 |
| 5,405,136 | A * | 4/1995 | Hardman | 473/342 |
| 5,954,596 | A * | 9/1999 | Noble et al. | 473/346 |
| 6,007,432 | A * | 12/1999 | Kosmatka | 473/324 |
| 6,478,693 | B2 * | 11/2002 | Matsunaga et al. | 473/345 |
| 6,508,722 | B1 * | 1/2003 | McCabe et al. | 473/330 |
| 6,602,150 | B1 * | 8/2003 | Kosmatka | 473/342 |
| 6,652,391 | B1 * | 11/2003 | Kubica et al. | 473/345 |
| 6,776,723 | B2 * | 8/2004 | Bliss et al. | 473/291 |
| 6,783,466 | B2 | 8/2004 | Seki et al. | |
| 6,899,638 | B2 * | 5/2005 | Iwata et al. | 473/329 |
| 6,929,566 | B2 * | 8/2005 | Sano | 473/349 |
| 6,966,848 | B2 * | 11/2005 | Kusumoto | 473/342 |
| 2002/0068646 | A1 * | 6/2002 | Yoneyama | 473/345 |
| 2002/0082117 | A1 * | 6/2002 | Nishitani et al. | 473/345 |
| 2002/0123394 | A1 * | 9/2002 | Tsurumaki | 473/345 |
| 2003/0036442 | A1 * | 2/2003 | Chao et al. | 473/345 |
| 2003/0078112 | A1 * | 4/2003 | Sugimoto | 473/342 |
| 2003/0176232 | A1 * | 9/2003 | Hasebe | 473/291 |
| 2004/0009830 | A1 * | 1/2004 | Nishio | 473/345 |
| 2005/0020379 | A1 * | 1/2005 | Kumamoto | 473/332 |
| 2005/0059508 | A1 * | 3/2005 | Burnett et al. | 473/349 |

FOREIGN PATENT DOCUMENTS

| | | |
|---|---|---|
| JP | 9-192273 A | 7/1997 |
| JP | 9-299519 A | 11/1997 |

* cited by examiner

*Primary Examiner*—Sebastiano Passaniti
(74) *Attorney, Agent, or Firm*—Birch, Stewart, Kolasch & Birch, LLP

(57) ABSTRACT

This present invention relates to a hollow golf club head comprising a face portion whose front face defines a club face for hitting a ball, wherein said face portion comprises a center portion forming an area having a sweet spot, and a peripheral portion surrounding the center portion and having the thickness smaller than the thickness of said center portion, wherein the thickness of the peripheral portion is reduced from the sole portion side of the head toward the crown portion side.

14 Claims, 9 Drawing Sheets section A - A section B - B section C - C section P1

GOLF CLUB HEAD

This Nonprovisional application claims priority under 35 U.S.C. § 119(a) on Patent Application No(s). 2003-362383 filed in Japan on Oct. 22, 2003, the entire contents of which are hereby incorporated by reference.

BACKGROUND OF THE INVENTION

1. Field of the Invention

The present invention relates to a golf club head by which an improvement of carry can be expected.

2. Description of the Related Art

In recent years, there has been proposed a golf club head in which an inner portion is formed hollow. The head mentioned above has a metal face portion for hitting a ball. Further, the face portion includes a center portion having a large thickness and the peripheral portion surrounding the center portion and having a smaller thickness than that of the center portion.

In the head mentioned above, a specific frequency of the head gets close to a specific frequency of the ball. Accordingly, an energy loss generated at a time of collision between the head and the ball is reduced, and a kinetic energy of the head is efficiently transferred to the ball. As a result, an initial velocity at a time of hitting the ball is increased, and an improvement of carry can be expected. In other words, the head mentioned above has a large restitution coefficient.

However, USGA and R&A reform the golf rules and limit the maximum value of the restitution coefficient of the head. The head described above goes beyond the maximum value of the restitution coefficient at a high possibility, and there is a possibility that the head described above can not be used in an official tournament hereafter. Accordingly, in order to provide a head which can be used in the official tournament while obtaining a long carry, it is necessary to improve the other matters than the restitution coefficient.

SUMMARY OF THE INVENTION

The present invention is worked out while taking the problems mentioned above into consideration, and a main object of the present invention is to provide a golf club head which serves for improving a carry of a hit ball, by optimizing an angle of hitting the ball and an amount of backspin.

In accordance with the present invention, there is provided a hollow golf club head comprising a face portion whose front face defines a club face for hitting a ball, wherein the face portion comprises a center portion forming an area having a sweet spot, and a peripheral portion surrounding the center portion and having a thickness smaller than a thickness of the center portion, wherein the thickness of the peripheral portion is reduced from the sole portion side of the head toward the crown portion side.

In the golf club head in accordance with the present invention, the thickness of the peripheral portion of the face portion is reduced from the sole portion of the head toward the crown portion side. Accordingly, when hitting the ball by the center portion, the crown portion side of the peripheral portion is largely deflected more to a rear side. On the other hand, since the thickness of the center portion is relatively larger than the thickness of the peripheral portion, the deformation of the center portion is restricted small. The center portion of the face portion generates a micro rotating motion that the crown portion side is tilted backward around the sole portion side of the head, on the basis of the operation mentioned above. This increases an apparent loft angle. Accordingly, the angle of hitting the ball is increased.

Further, the ball is affected by a so-called "gear effect" on the basis of the rotating motion of the center portion which is in contact with the ball. In other words, a force in a direction of canceling the backspin (in a direction of topspin) is applied to the ball. Accordingly, an amount of backspin of the ball is reduced. As mentioned above, the golf club head in accordance with the present invention can hit the ball at a high hitting angle and at a low backspin amount. This serves for improving the carry.

DESCRIPTION OF THE PREFERRED EMBODIMENTS

Figure 1:
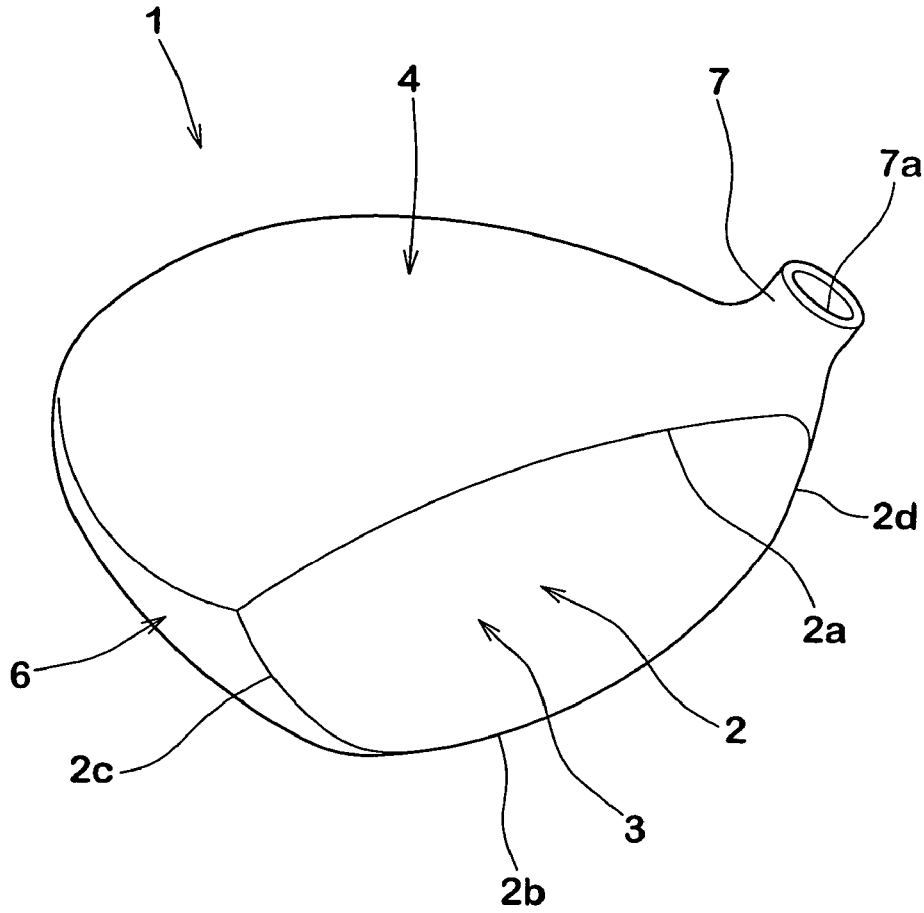
FIG. 1 is a perspective view of a standard condition of a golf club head in accordance with the present embodiment.

Embodiments of the present invention will now be described in detail in conjunction with the accompanying drawings.

In the drawings, club head 1 according to the present invention is a wood-type club head such as #1 driver and fairway wood. The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face of the club head; and a neck portion 7 to be attached to an end of a club shaft (not shown). In this case, the neck portion 7 has a cylindrical shaft insertion hole 7*a*, and an axial center line CL thereof is set as a standard of a lie angle β (shown in FIG. 3).

It is desirable that a head 1 is formed by a metal material, for example, an aluminum alloy, a titanium, a titanium alloy, a stainless steel and others, however, may be structured by using a fiber reinforced resin. In the present embodiment, the titanium alloy is employed. Further, the head is manufactured, for example, by using a forged member, a casted member, a pressed member, a rolled member and the like.

Figure 2:
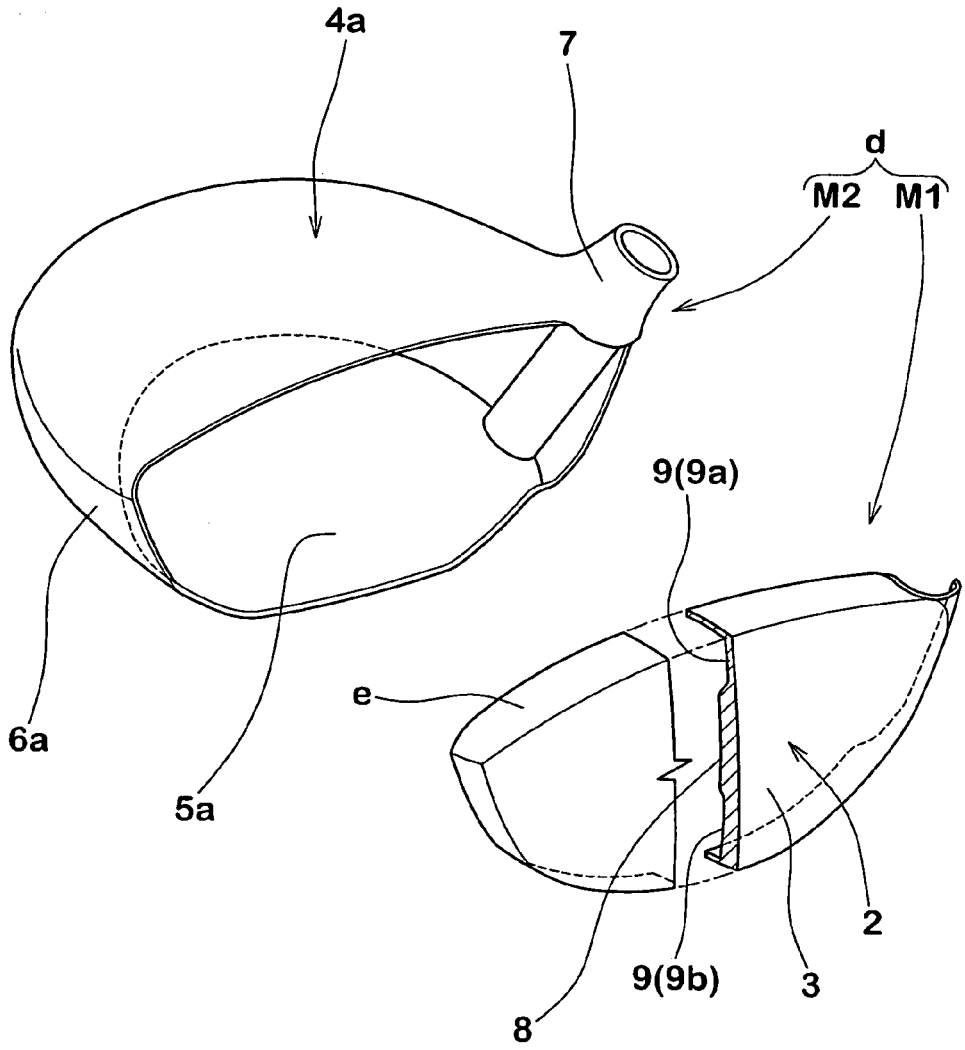
FIG. 2 is an exploded perspective view of FIG. 1.

The head 1 in accordance with the present embodiment is formed by firmly attaching a face member M1 to a head main body M2, as shown in FIG. 2 in an exploded manner.

The face member M1 comprises the face portion 3 and the extended edge portion "e" extending from the periphery of the face portion 3 to a rear side of the head. Further, the head main body M2 comprises a crown main portion 4*a*, a sole main portion 5*a*, a side main portion 6*a* and the neck portion 7. In this embodiment, the face member M1 is constituted by the forged member, and the head main body M2 is constituted by the casted member. In this case, the structure is not limited to this, and it goes without saying that the face member and the head main body can be manufactured by the other materials and in accordance with the other molding methods.

The head 1 has a cavity (i) immediately behind the face portion 3, and in the following embodiments, the cavity (i) is left void although it is also possible to fill it with a light-weight material such as foamed plastic, foamed rubber or the like. In this case, a filling material is arranged so as to be prevented from being in contact with at least a back surface of the face portion 3.

As shown in FIGS. 3 to 6, the face portion 3 comprises a center portion 8 forming a main hitting area having a sweet spot SS, and a peripheral portion 9 surrounding the center portion 8 and having a thickness smaller than a thickness of the center portion 8. Further, the thickness of the peripheral portion 9 is reduced from a sole portion side of the head toward the crown portion side.

Figure 4:
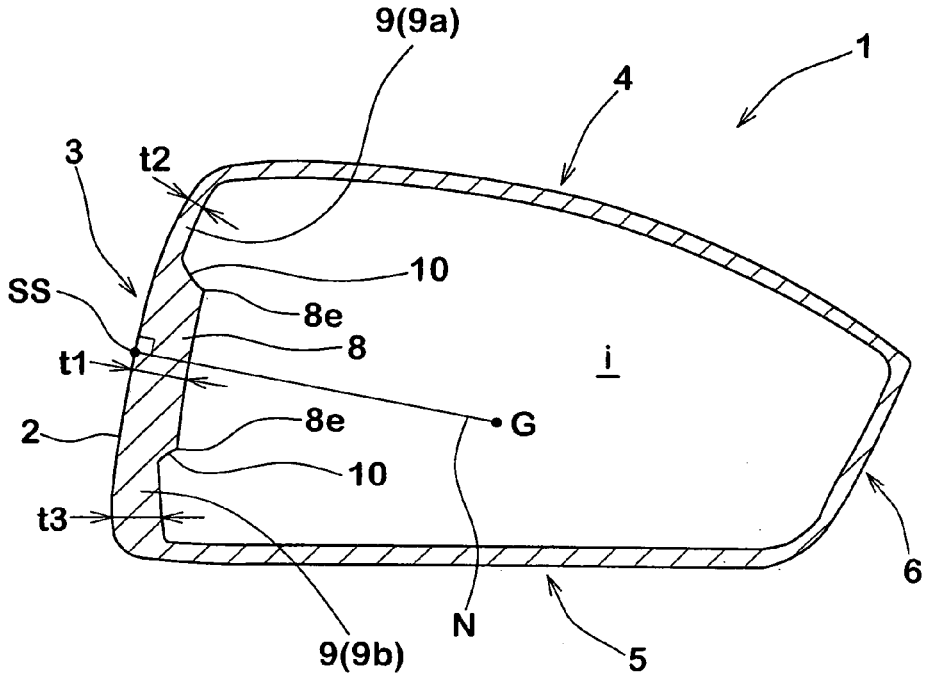
FIG. 4 is an end elevational view along a line A-A in FIG. 3.
Figure 5:
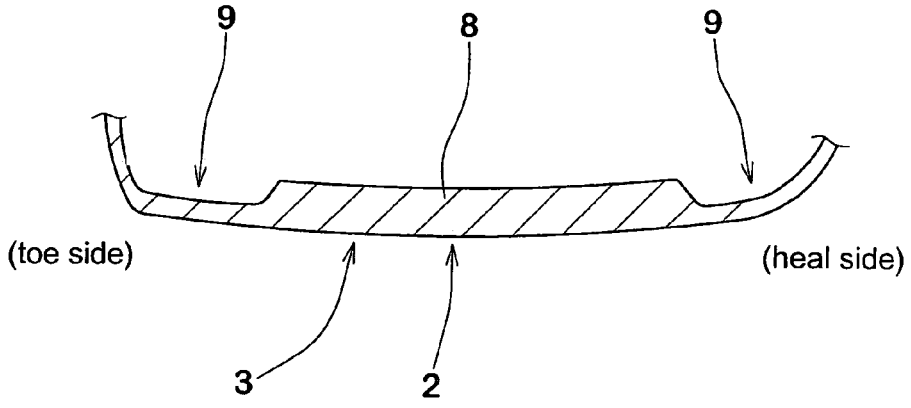
FIG. 5 is an end elevational view along a line B-B in FIG. 3.
Figure 6:
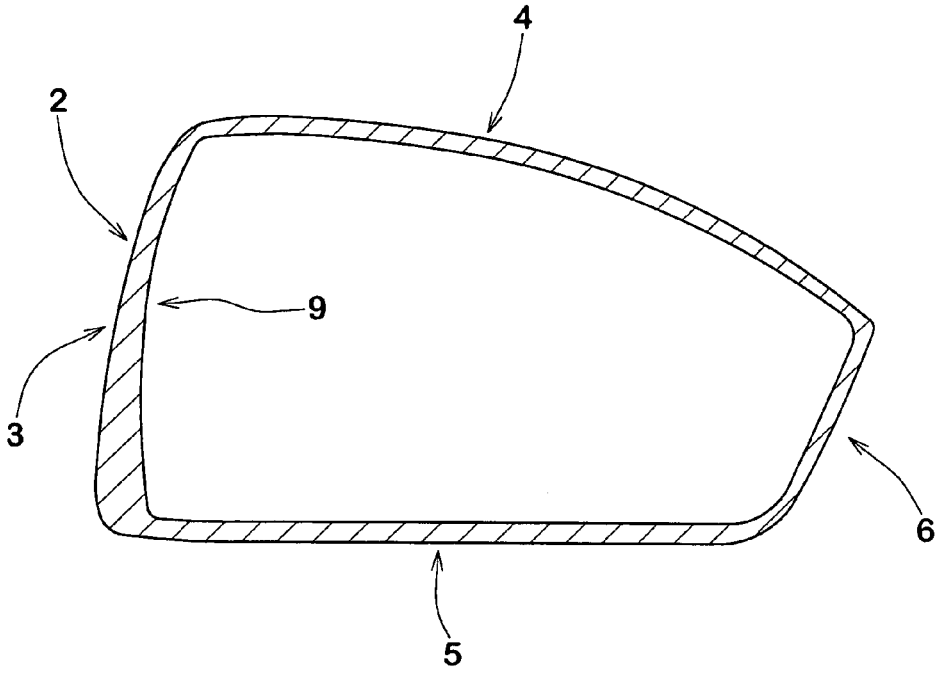
FIG. 6 is an end elevational view along a line C-C in FIG. 3.

As shown in FIG. 4, the sweet spot SS is a point at which a normal line N drawn down from a head gravity point G to the club face 2 intersects the club face 2. The sweet spot SS means a hitting point most effectively transmitting the kinetic energy of the head to the ball. Since the center portion 8 includes the sweet spot SS, the center portion 8 is a preferable hitting area. Further, the center portion 8 has a maximum thickness t1 in the face portion 3 in the present embodiment, and approximately a whole area of the center portion 8 is substantially formed by the maximum thickness t1.

Since the center portion 8 corresponds to the area for frequently hitting the ball, a great strength is required for the center portion 8. Accordingly, if the thickness t1 is too small, there is a tendency that the strength runs short and the durability is deteriorated. On the contrary, if the thickness t1 is too large, the restitution coefficient is excessively lowered, so that it is impossible to improve a carry of the hit ball. Although not being limited, the thickness t1 of the center portion 8 is preferably in a range of from 2.5 to 3.8 mm. Further, the thickness t1 is more preferably in a range of not less than 2.7 mm. Further, the thickness t1 is more preferably in a range of not more than 3.5 mm, still more preferably not more than 3.2 mm.

Further, the center portion 8 is exemplified by a structure formed approximately in a similar shape to an edge E of the club face 2. The edge E of the club face 2 is formed by the upper edge 2*a*, the lower edge 2*b*, the toe-side edge 2*c* and the heel-side edge 2*d*. Further, it is desirable that the sweet spot SS is provided approximately in a center of the center portion 8.

Figure 11A:
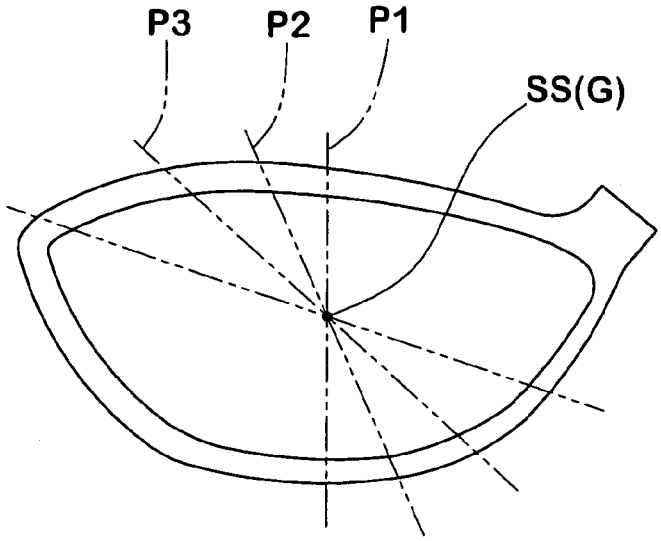
FIGS. 11A and 11B are diagrammatic views explaining an edge of the club face.
Figure 11B:
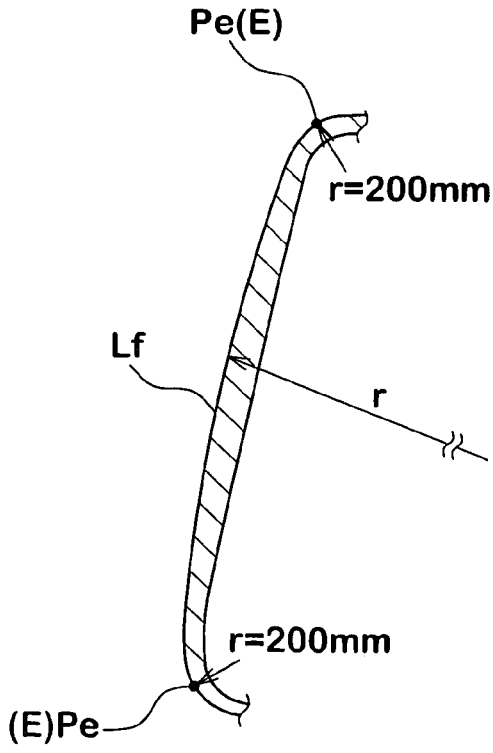

In the case that the edge E of the club face appears as a clear ridge line, the edge E of the club face is defined by the ridge line. However, in the case that the ridge line is not clear, the edge is defined in the following manner. First, as shown in FIG. 11A, the head is cut by a lot of planes P1, P2, . . . each including the normal line N connecting the head gravity point G and the sweet spot SS. An example of a cross section thereof is shown in FIG. 11B. Further, in the cross section mentioned above, a position Pe at which a radius r of curvature of a profile line Lf of the club face 2 first comes to 200 mm from the center side of the club face 2 is specified as the edge E of the club face in the cross section. The edge mentioned above can be determined, for example, by measuring the planes P1, P2, . . . in a small angle (for example, 5 degree) increment.

Figure 3:
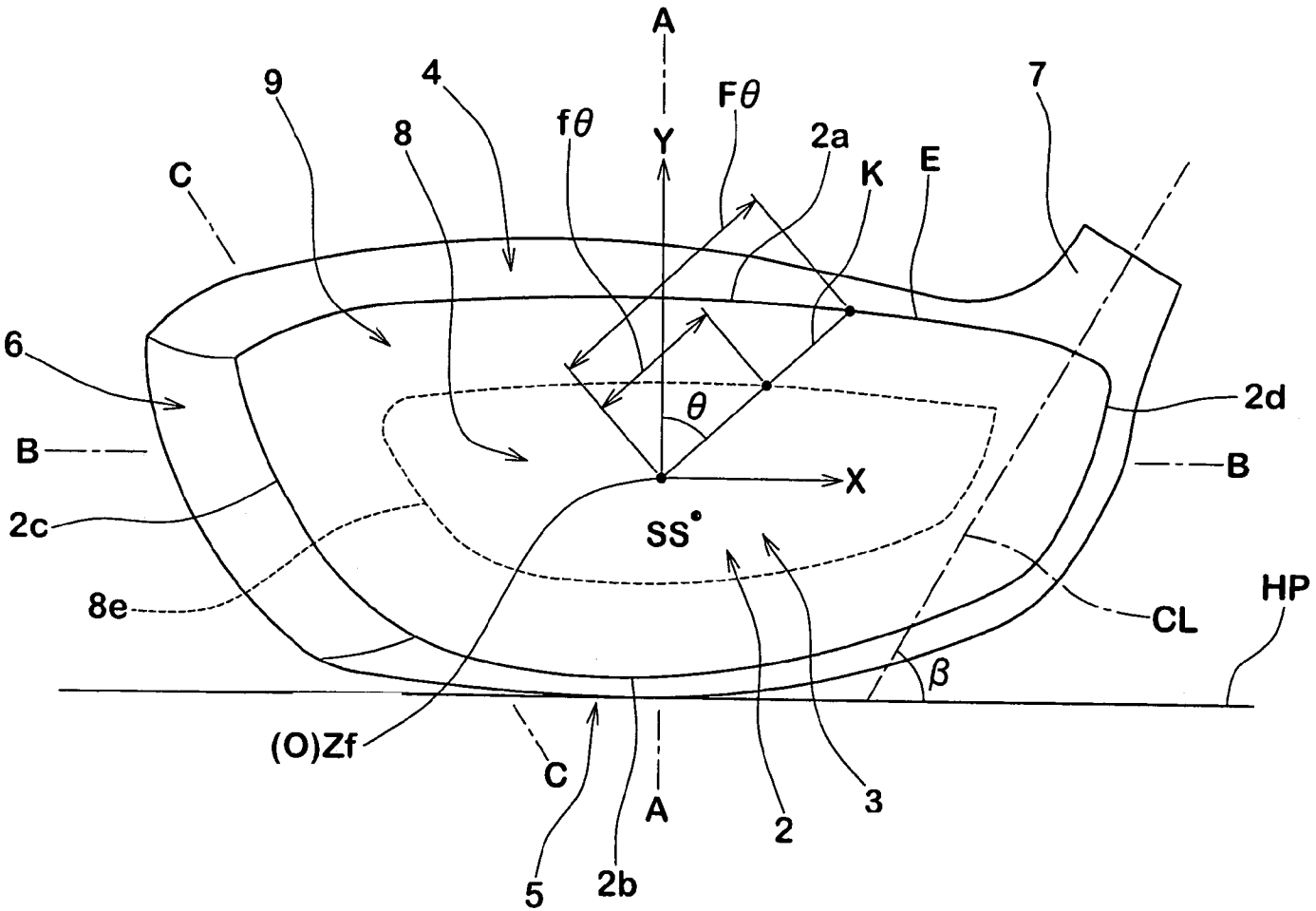
FIG. 3 is an enlarged front elevational view of the same.

Further, for example, as shown in FIG. 3, a normal coordinate X-Y is set by setting a centroid Zf of the club face 2 to an origin. The X-Y coordinate is of two dimensions, and is given on a plane which is in contact with the centroid. In a straight line K which is inclined at an angle θ (θ=range between 0 and 360 degree) from the Y-axis and extends from the origin O to the edge E of the club face 2, a ratio (fθ/Fθ) between the distance Fθ from the origin O to the edge E of the club face, and the distance fθ from the origin to the edge 8*e* of the center portion 8 is desirably in the range from 0.4 to 0.8. The range determined by the function mentioned above is approximate to a hitting distribution range of an average golfer. Accordingly, it is possible to hit the ball by the center portion 8 at a higher probability. Of course, it is necessary that the sweet spot SS is included in the range, and it is desirable that an area obtained by projecting the edge 8*e* of the center portion 8 into the club face 2 is preferably 20 to 60% of a surface area of the club face 2, and more preferably 20 to 40%.

The peripheral portion 9 continuously surrounds the center portion 8 as shown in FIGS. 3 to 6, in the present embodiment. Further, the thickness of the peripheral portion 9 is smoothly reduced from the sole portion side toward the crown portion side. Although not being illustrated, the thickness of the peripheral portion 9 may be reduced step by step. The peripheral portion 9 of the present embodiment includes a crown portion side peripheral portion 9*a* positioned close to the crown portion 4 side rather than the center portion 8, and a sole portion side peripheral portion 9*b* positioned close to the sole portion 5 side rather than the center portion 8. Further, the peripheral portions 9 positioned at the same height from the horizontal surface HP have approximately the same thickness, in a standard condition. In other words, in the face cross section cut by the horizontal surface (FIG. 5) at an optional height, the toe side and heel side peripheral portions 9 have substantially the same thickness. In this case, for example, a difference may be provided in the thickness between the toe side and the heel side of the peripheral portion 9.

In this case, the standard condition corresponds to a state in which the head 1 is brought into contact with the horizontal surface at prescribed lie angle and loft angle (real loft angle).

The inventors of the present invention have carried out various experiments while paying attention to the ball hitting angle and the backspin amount. In the case of hitting the ball at about an average head speed 40 m/s of the average golfer, the condition for obtaining the long carry is that the ball hitting angle is about 17 degree, and the backspin amount is about 1800 rpm. However, an actual measured value of the average golfer is constituted by about 8 to 14 degree of the hitting angle, and about 2000 to 3500 rpm of the backspin amount.

Accordingly, in order to increase the carry of the average golfer in a wood type golf club such as a driver or the like, it is necessary to make the hitting angle higher and further reduce the backspin amount. In order to increase the hitting angle of the ball, it is generally necessary to make the loft angle of the head large. However, in accordance with this method, the back spin amount is increased as well as the hitting angle. The head 1 in accordance with the present invention can make the hitting angle large while inhibiting the backspin amount from being increased. The reason will be described below.

Figure 7:
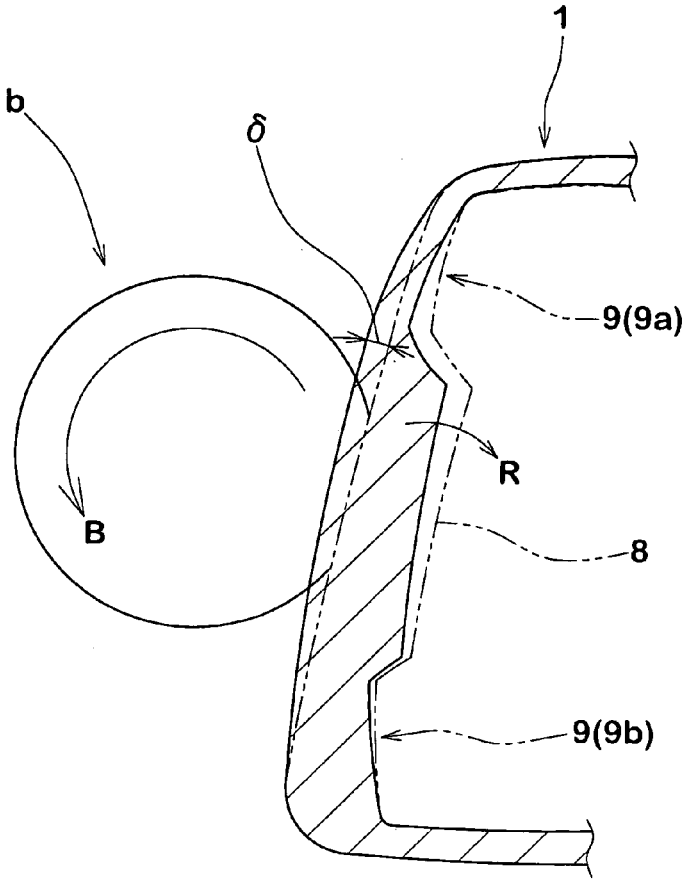
FIG. 7 is a partly enlarged view of FIG. 4 and schematically shows a deformation at a time of hitting a ball.

As shown in FIG. 7, when hitting the ball by the center portion 8 of the head 1, the peripheral portion 9*a* in the crown portion side having the smaller thickness is deflected to a rear side of the head more largely than the peripheral portion 9*b* in the sole portion side. On the other hand, since the thickness of the center portion 8 is relatively larger than the peripheral portion 9, the center portion 8 can be inhibited from being deformed largely and can maintain a shape thereof substantially. On the basis of the operation mentioned above, there is generated a rotating motion R that the center portion 8 in the crown portion side tilts rearward at a micro angle δ around the sole portion side corresponding to a supporting point. This motion increases an apparent loft angle of the head 1 and increases the ball hitting angle. Further, on the basis of the rotating motion of the center portion 8, a force B in a direction of canceling the backspin (a direction of the topspin) is applied to the ball b owing to a so-called gear effect. Accordingly, the backspin amount of the ball b is reduced. In other words, the head 1 in accordance with the present invention hits the ball at the high hitting angle and the low backspin amount in comparison with the conventional one, and improves the carry by extension.

As shown in FIG. 4, the thickness t2 of the peripheral portion 9*a* in the crown portion side is determined in view of the thickness of the center portion 8, is preferably in a range of from 1.5 to 2.5 mm, and is more preferably from 1.8 to 2.3 mm. In this case, the thickness t2 is set to be smaller than the maximum thickness t1 of the center portion 8. In the case that the thickness t2 is smaller than 1.5 mm, the deformation of the peripheral portion 9*a* in the crown portion side is excessively increased at a time of hitting the ball, whereby the durability tends to be lowered. On the contrary, in the case that the thickness t2 is more than 2.5 mm, the difference in thickness from the center portion 8 becomes small, whereby the deforming amount of the crown portion side can not be sufficiently obtained. This matter lowers the effect of increasing the apparent loft angle. It is particularly preferable that a difference (t1−t2) between the maximum thickness t1 of the center portion 8 and the thickness t2 of the peripheral portion 9*a* in the crown portion side is in the range from 0.5 to 2.0 mm, and is more preferably from 0.8 to 2.0 mm, in the vertical cross section passing through the centroid Zx of the club face 2 in the standard condition mentioned above.

Further, a maximum thickness t3 of the peripheral portion 9*b* in the sole portion side mentioned above is also determined in view of the thickness of the center portion 8, is preferably set to 2.0 to 3.5 mm, and is more preferably set to 2.3 to 3.2 mm. In the case that the thickness t3 is smaller than 2.0 mm, the deformation of the peripheral portion 9*b* in the sole portion side is increased at a time of hitting the ball, whereby the durability tends to be lowered. Further, the large deformation which is similar to that of the peripheral portion 9*a* in the crown portion side is generated at a time of hitting the ball, whereby it is impossible to sufficiently obtain the effect of increasing the apparent loft angle. On the contrary, in the case that the thickness t3 is more than 3.5 mm, the rigidity of the face portion 3 is excessively increased, and the repulsion performance tends to be lowered. It is particularly preferable that a ratio (t3/t2) between the maximum thickness t3 of the peripheral portion 9*b* in the sole portion side and the minimum thickness t2 of the peripheral portion 9*a* in the crown portion side is in a range of from 1.2 to 2.5, is more preferably larger than 1.3 and equal to or smaller than 2.3, and is further preferably in a range of from 1.4 to 2.0, in the vertical cross section.

Figure 8:
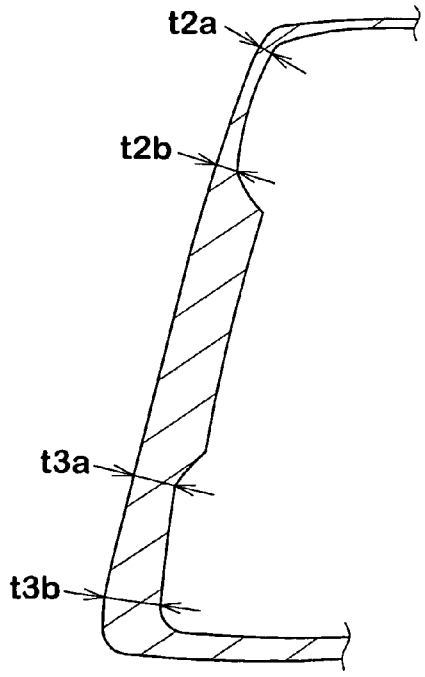
FIG. 8 is a vertical cross sectional view passing through a centroid of a club face.

In this case, the thickness t2 of the peripheral portion in the crown portion side is set to an average value of the respective thickness t2*a* and t2*b* of the upper end portion and the lower end portion thereof, as shown in FIG. 8 corresponding to the vertical cross section. In the same manner, the thickness t3 of the peripheral portion in the sole portion side is set to an average value of the respective thickness t3*a* and t3*b* of the upper end portion and the lower end portion thereof.

A joint portion 10 is provided in a boundary portion between the peripheral portion 9 and the center portion 8. In order to absorb the difference between the center portion 8 and the peripheral portion 9, a thickness of the joint portion 10 is smoothly changed. The joint portion 10 in accordance with the present embodiment is formed in a taper shape extending from an inner edge of the peripheral edge portion 9 to the center portion 8, in the cross sectional shape shown in FIG. 4. The joint portion 10 mentioned above prevents a stress concentration applied to the boundary portion between the peripheral portion 9 and the center portion 8, and improves the durability of the face portion 3.

Figure 9:
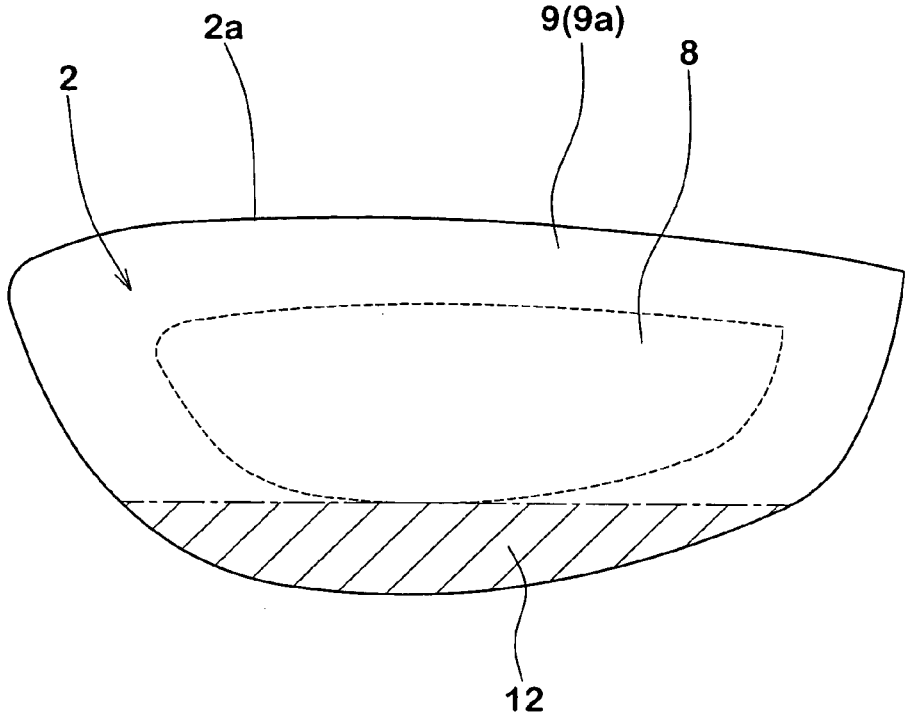
FIG. 9 is a schematic view of a club face showing another embodiment of a peripheral portion.

FIG. 9 shows another embodiment of the peripheral portion 9. In this embodiment, the peripheral portion 9 is formed as a discontinuous ring shape having an intermittence portion 12 (shown by a hatched line) arranged in the sole portion side. The peripheral portion 9 does not have the peripheral portion 9*b* in the sole portion side. However, since the peripheral portion is formed in the main portion in the periphery of the center portion 8, the same operation and effect as those of the embodiment mentioned above can be obtained. In this case, the intermittence portion 12 is formed substantially in the same thickness as that of the center portion 8.

Figure 10:
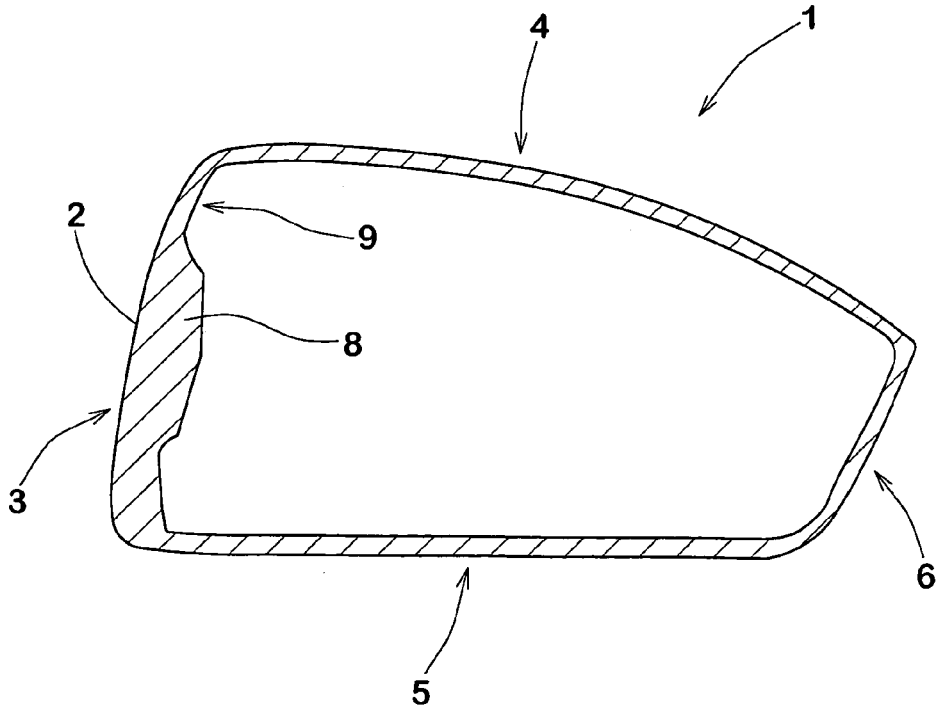
FIG. 10 is a head cross sectional view showing another embodiment in accordance with the present invention.

Further, FIG. 10 shows another embodiment of the center portion 8. In this embodiment, there is shown the center portion 8 in which a thickness is gradually increased toward the center. In accordance with this structure, it is possible to uniformize a strength balance of the center portion 8 and intend to further improve the durability, by increasing the center position to which the largest force is applied at a time of hitting the ball. Further, in the aspect that the thickness of the center portion 8 is changed as mentioned above, it is desirable that the thickness of the center portion 8 is determined in accordance with the maximum thickness standard mentioned above, that is, within the range from 2.5 to 3.5 mm.

EXAMPLES

A driver head with a head volume of 360 $cm^3$, and having a real loft angle of 10 degree and a hook angle of 2 degree is manufactured by way of trial on the basis of the specification in Table 1. Each of the heads is manufactured by welding a face member constituted by a cup-shaped forged product and a head main body constituted by a casted product, as shown in FIG. 2. In this case, Ti-4.5Al-3V-2Mo-2Fe (SP700) is employed as a material of the face member, and Ti-6Al-4V is employed as a material of the head main body, respectively. Further, the wood type golf club having an entire length of 45 inch is manufactured by firmly fixing a shaft to each of the trial heads, and the following tests are executed.

Restitution Coefficient of Head

The restitution coefficient of the head is measured on the basis of Procedure for Measuring the Velocity Ratio of a Club Head for Conformance to Rule 4-1e, Revision 2 (Feb. 8, 1999) of U.S.G.A. The larger the numeral value is, the better the head is.

Actual Hitting Test

An actual hitting test is executed by seven golfers (HDCP 1 to 15), and the ball hitting angle, the backspin amount and the total carry are respectively measured. The head speeds of the golfers are about 40 to 47 m/s. Evaluation is exhibited by an average value of results of all the golfers.

Durability Test

The durability test is executed by using a shot robot III produced by MIYAMAE Co., Ltd., and continuously hitting three thousands of 2 piece golf balls at a head speed of 50 m/s and at a hitting point of the face center, thereby checking whether or not a crack, a damage or the like is generated in the face portion.

A Result of the test is shown in Table 1.

TABLE 1

| | | | Example 1 | Example 2 | Comparative Example 1 | Comparative Example 2 | Example 3 | Comparative Example 3 | Example 4 | Comparative Example 4 |
|---|---|---|---|---|---|---|---|---|---|---|
| Thickness of center portion t1 [mm] | | | 2.9 | 2.9 | 2.8 | 2.9 | 3.6 | 3.6 | 2.9 | — |
| Thickness of peripheral portion in sole portion side t3 [mm] | | | 2.9 | 2.6 | 2.8 | 2.2 | 2.9 | 2.3 | 2.4 | 3.4 |
| Thickness of peripheral portion in crown portion side t2 [mm] | | | 1.8 | 2.0 | 2.8 | 2.2 | 1.8 | 2.3 | 1.4 | 2.2 |
| t1 − t2 [mm] | | | 1.1 | 0.9 | 0 | 0.7 | 1.8 | 0 | 1.5 | — |
| t3/t2 | | | 1.6 | 1.3 | 1.0 | 1.0 | 1.6 | 1.0 | 1.7 | 1.5 |
| Ratio (f/F) | | | 0.6 | 0.6 | — | 0.6 | 0.6 | 0.6 | 0.6 | — |
| Test result | Restitution coefficient of head | | 0.82 | 0.83 | 0.79 | 0.83 | 0.77 | 0.77 | 0.84 | 0.79 |
| | Actual hitting test | Hitting angle [deg] | 11.9 | 11.5 | 11.1 | 11.2 | 11.6 | 11.1 | 12.0 | 11.2 |
| | | Backspin amount [rpm] | 2000 | 2200 | 2400 | 2400 | 2100 | 2400 | 2000 | 2600 |
| | | Total carry [yard] | 242 | 239 | 224 | 231 | 227 | 221 | 243 | 221 |
| | Durability test | | Acceptance | Acceptance | Acceptance | Acceptance | Acceptance | Acceptance | Depression is generated in face by 2800 hits | Crack is generated in face by 2300 hits |

Example 1 is a most preferable aspect, and the peripheral portion is intermittent in the sole portion side, as shown in FIG. 9. In accordance with Example 1, it is known that the hitting angle is high and the backspin is low, in comparison with Comparative Examples 1 and 2. Further, while the restitution coefficient is small in comparison with Comparative Example 2, it is possible to confirm that the carry is 11 yard increased on the basis of a synergistic action of the high hitting angle and the low backspin.

Example 2 is structured such that the peripheral portion is formed in a continuous ring shape, and the value of t3/t2 is made smaller than Example 1. In comparison with Comparative Examples 1 and 2, the hitting angle is high and the backspin is low. However, in comparison with Example 1, the effect of increasing the hitting angle and the effect of reducing the backspin amount are slightly inferior. Accordingly, it is known that the ratio (t3/t2) is desirably larger than 1.3.

Example 3 is structured such that the thickness of the center portion is increased. The peripheral portion is set to be the same as Example 1. The hitting angle is high and the backspin amount is low, however, since the thickness of the center portion is slightly larger, the carry is slightly disadvantageous by a small restitution coefficient. However, since the hitting angle is high and the backspin amount is small in comparison with Comparative Example 3 in which the center portion is set to be the same thickness, an advantage in carry can be confirmed.

Since Example 4 is structured such that the thickness t2 of the peripheral portion in the crown portion side is set to be slightly smaller, a depression of the face appears at a time of hitting about 2800 balls in the durability test. In this case, the practical durability is considered to be sufficiently satisfied.

Figure 12:
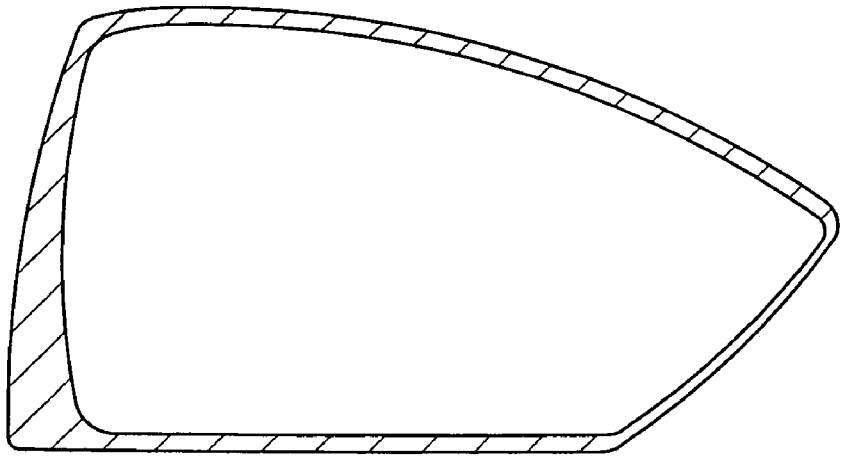
FIG. 12 is a vertical cross sectional view of a face portion of a head in accordance with Comparative Example 4.

Comparative Example 4 is structured, as shown in FIG. 12, such that the thickness of an entire of the face portion 2 is reduced from the sole portion side to the crown portion side, without arranging the center portion having the large thickness. In this structure, since the thin portion of the face is largely deflected in comparison with the thick portion at an impact time, the backspin tends to be increased. As a result, the spin amount is increased and the carry is deteriorated. Further, since the peripheral thin structure is not provided, the repulsion performance is inferior, the sweet area becomes narrow, and the dispersion of carry is increased due to the dispersion of the hitting point. Accordingly, the average carry is inferior. Further, since the thinnest portion of the face is positioned near the boundary with the crown portion having the larger impact at a time of hitting the ball, the breakage is generated due to the stress concentration, so that the durability is inferior.

The invention claimed is:

1. A hollow golf club head comprising a face portion whose front face defines a club face for hitting a ball, a crown portion intersecting the club face at the upper edge thereof, and a sole portion intersecting the club face at the lower edge thereof, wherein said face portion comprises a center portion forming an area having a sweet spot, and a peripheral portion surrounding the center portion and having the thickness smaller than the thickness of said center portion, wherein the peripheral portion comprises a crown side portion provided between said center portion of the face portion and the crown portion, and a sole side portion provided between said center portion of the face portion and the sole portion, the thickness of said peripheral portion is reduced from the sole portion side toward the crown portion side, and a ratio (t3/t2) between the thickness t3 of the sole side peripheral portion and the thickness t2 of the crown side peripheral portion being in a range of from 1.2 to 2.0, in a vertical cross section passing through a centroid of the club face under a standard condition in which the club head is placed on a horizontal surface at its lie angle and its loft angle.

2. The golf club head according to claim 1, wherein the thickness of the center portion is substantially fixed.

3. The golf club head according to claim 1 or 2, wherein the thickness of the center portion is largest in the face portion.

4. A golf club head according to claim 1, wherein the thickness of the center portion is gradually increased toward a center.

5. The golf club head according to claim 1, wherein the thickness of the center portion is in a range of from 2.5 to 3.8 mm.

6. The club head according to claim 1, wherein the profile shape of the center portion is similar to a shape drawn by the edge of the club face.

7. The club head according to claim 1, wherein the peripheral portion is completely continuous around the center portion.

8. The golf club head according to claim 7, wherein the peripheral portion comprises a toe side portion provided between the center portion of the face portion and a toe of the club head and a heel side portion provided between the center portion of the face portion and a heel of the club head, and each of the toe and heel side portions has substantially the same thickness at the same height from the horizontal surface.

9. A golf club head according to claim 1, wherein the peripheral portion is intermittent in the sole portion side.

10. The golf club head according to claim 1, wherein the thickness of the peripheral portion is smoothly reduced from the sole portion side toward the crown portion side.

11. The golf club head according to claim 1, wherein the ratio (t3/t2) is in a range of from 1.4 to 2.0.

12. The golf club head according to claim 1, wherein the difference (t1-t2) between the maximum thickness t1 of the center portion and the thickness t2 of the crown side portion in the crown portion side is in a range of from 0.5 to 2.0 mm, in a vertical cross section passing through a centroid of the club face under a standard condition in which the head is brought into contact with the horizontal surface at prescribed lie angle and loft angle.

13. The golf club head according to claim 1, wherein in the face portion, the ratio (f/F) between the distance F from a centroid of the club face to an edge of the club face, and the distance f from said centroid to an edge of the center portion is in a range of from 0.4 to 0.8, in an optional straight line K extending from the centroid to the edge of the club face.

14. The golf club head according to claim 1, wherein the thickness t3 of the sole side portion is in a range of from 2.0 to 3.5 mm.

* * * * *